US005482342A

United States Patent [19]

Kowalski et al.

[11] Patent Number: 5,482,342

[45] Date of Patent: Jan. 9, 1996

[54] REMOVABLE AND TRANSPORTABLE STORAGE BIN ORGANIZER

[76] Inventors: Dennis G. Kowalski, 109 Lake Aire Dr.; Laureen A. Davis, P.O. Box 211, Chetak, both of Wis. 54728

[21] Appl. No.: 202,732

[22] Filed: Feb. 28, 1994

[51] Int. Cl.[6] ..... A47G 29/00

[52] U.S. Cl. ..... 294/160; 294/143; 294/161; 211/71; 220/532; 220/377

[58] Field of Search ..... 294/141, 142, 294/143, 146, 159, 160, 161, 162; 211/71, 126; 220/532, 533, 377; 312/348.3, 350, 902; 206/214, 372, 373, 503

[56] References Cited

U.S. PATENT DOCUMENTS

| | | | |
|---|---|---|---|
| 2,125,856 | 8/1938 | De Witt | 220/532 |
| 3,233,804 | 2/1966 | Dahm | 294/160 |
| 3,552,612 | 1/1971 | Greis | 224/45 |
| 3,581,906 | 6/1971 | Joyce | 220/532 X |
| 3,606,949 | 9/1971 | Joyce | 211/126 |
| 4,231,626 | 11/1980 | Amtmann et al. | 312/350 |
| 4,234,089 | 11/1980 | Morris | 220/532 X |
| 4,544,213 | 10/1985 | Long et al. | 220/532 X |
| 4,709,815 | 12/1987 | Price et al. | 294/161 X |
| 4,832,422 | 5/1989 | Fortmann | 312/350 X |
| 4,875,744 | 10/1989 | Wettstein | 312/266 |
| 5,244,265 | 9/1993 | Chiang | 312/902 X |

*Primary Examiner*—Dean Kramer
*Attorney, Agent, or Firm*—David L. Baker; Henry S. Miller; Rhodes & Ascolillo

[57] ABSTRACT

A storage assembly has a storage rack. The storage rack has a back rack wall, a right side rack wall connected to the back rack wall and a left side rack wall connected to the back rack wall. The left side rack wall directly opposes the right side rack wall. At least one first rail, but preferably a plurality of first rails, are connected to the right side rack wall. At least one second rail, but preferably a plurality of second rails, are connected to the left side rack wall. There is a top rack wall and a bottom rack wall connected to the back rack wall. The top rack wall is also connected to the left side rack wall and connected to the right side rack wall. At least one storage bin has a back bin wall and a front bin wall. The storage bin has a right side bin wall connected to the back bin wall and connected to the front bin wall. A left side bin wall is connected to the back bin wall and is connected to the front bin wall. There is a first groove, to receive the first rail, in the right side bin wall. There is a second groove, to receive the second rail, in the left side bin wall. There is a third groove in the back bin wall and a fourth groove, in the front bin wall. The fourth groove directly opposes the third groove. A removable partition wall has a rear edge inserted in the third groove and a front edge inserted in the fourth groove. A transparent lid is hingingly connected to the back bin wall.

5 Claims, 5 Drawing Sheets

REMOVABLE AND TRANSPORTABLE STORAGE BIN ORGANIZER

BACKGROUND OF THE INVENTION

1. Field of the Invention

This invention relates to a plurality of storage bins that may be placed in a stationary storage rack or removed and placed in a portable storage rack. The bins allow the user to segregate parts and equipment needed for a particular job into a particular bin which then is held in readiness for the time that job is ready to be addressed.

2. Description of the Related Art

Previous bin assemblies have not provided the users the ease and convenience of designating a particular partitioned bin with selected parts or tools, removable from a common structure, for a particular job or for a sequence in a job.

U.S. Pat. No. 3,552,612 to H. A. Greis on Jan. 05, 1971 for a Rack Structure shows a rack structure having arms to hold the neck of a plurality of jars. The rack had a handle and is portable.

U.S. Pat. No. 3,606,949 to J. E. Joyce on Sep. 21, 1971 for a Transportable Storage Bin Assembly describes stackable storage bins having a releasable and extensible handle.

U.S. Pat. No. 4,875,744 to U. Wettstein on Oct. 24, 1989 for a Parts Organizer shows a structure having a plurality of curved trays with partitions and a cover to reduce intermingling of parts into other trays.

The present invention presents a solution to this problem by presenting a storage assembly that not only allows the user to classify parts and tools in a centrally located stationary rack but also allows the user to transport individual bins to a job site by selecting a bin or bins designated for that job and, if desired, placing the bin or bins into a rack having optional features to enhance portability.

SUMMARY OF THE INVENTION

In one aspect of the present invention, a storage assembly is shown that has a storage rack. The storage rack has a back rack wall and a right side rack wall connected to the back rack wall. A left side rack wall is also connected to the back rack wall. The left side rack wall opposes the right side rack wall. There is at least one first rail connected to the right side rack wall and at least one second rail connected to the left side rack wall. The second rail opposes the first rail.

There is at least one storage bin. Each storage bin has a back bin wall and a front bin wall. The storage bin has a right side bin wall connected to the back bin wall and connected to the front bin wall. A left side bin wall is connected to the back bin wall and is also connected to the front bin wall. The left side bin wall opposes (i.e. is placed directly across from) the right side bin wall. There is a first groove, to receive the first rail, in the right side bin wall. There is a second groove, to receive the second rail, in the left side bin wall.

There is a third groove in the back bin wall. There is a fourth groove, in the front bin wall, opposing the third groove. A removable partition wall has a rear edge inserted in the third groove a front edge inserted in the fourth groove. A transparent lid is pivotally connected to the right side bin wall. The storage rack may have a handle attached to the left side rack wall and attached to the right side rack wall to facilitate lifting the storage rack.

It is an object of this invention to provide a storage assembly that will enable the user to segregate parts and/or tools into separate bins that may be used at a preselected time at the site of the storage assembly or brought out to the work site at the time the parts and or tools are needed.

DESCRIPTION OF THE PREFERRED EMBODIMENTS

Figure 1:
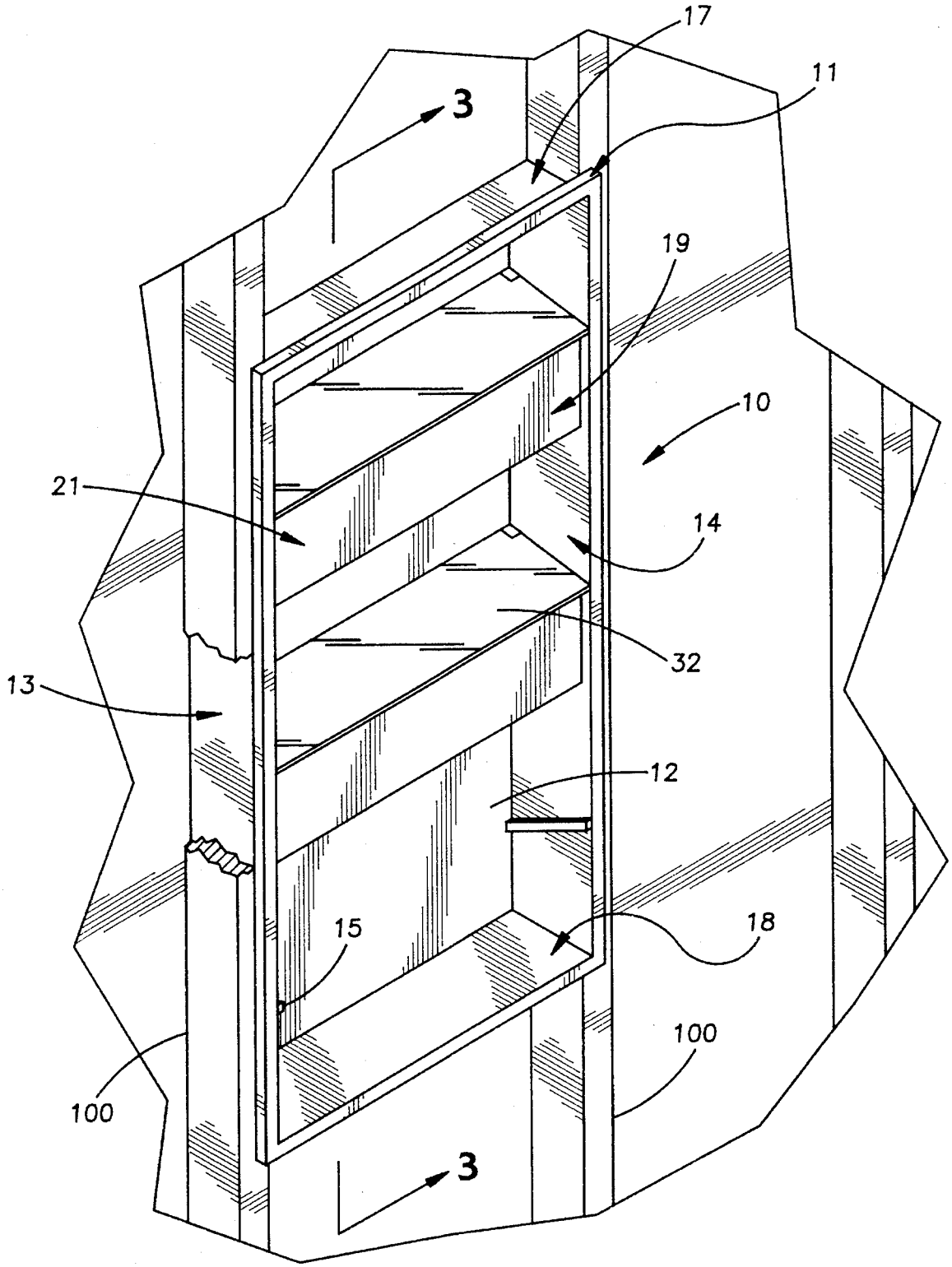
FIG. 1 is a perspective view of the Storage Assembly shown placed inbetween two upright members and showing the upright members in a partial view.
Figure 2:
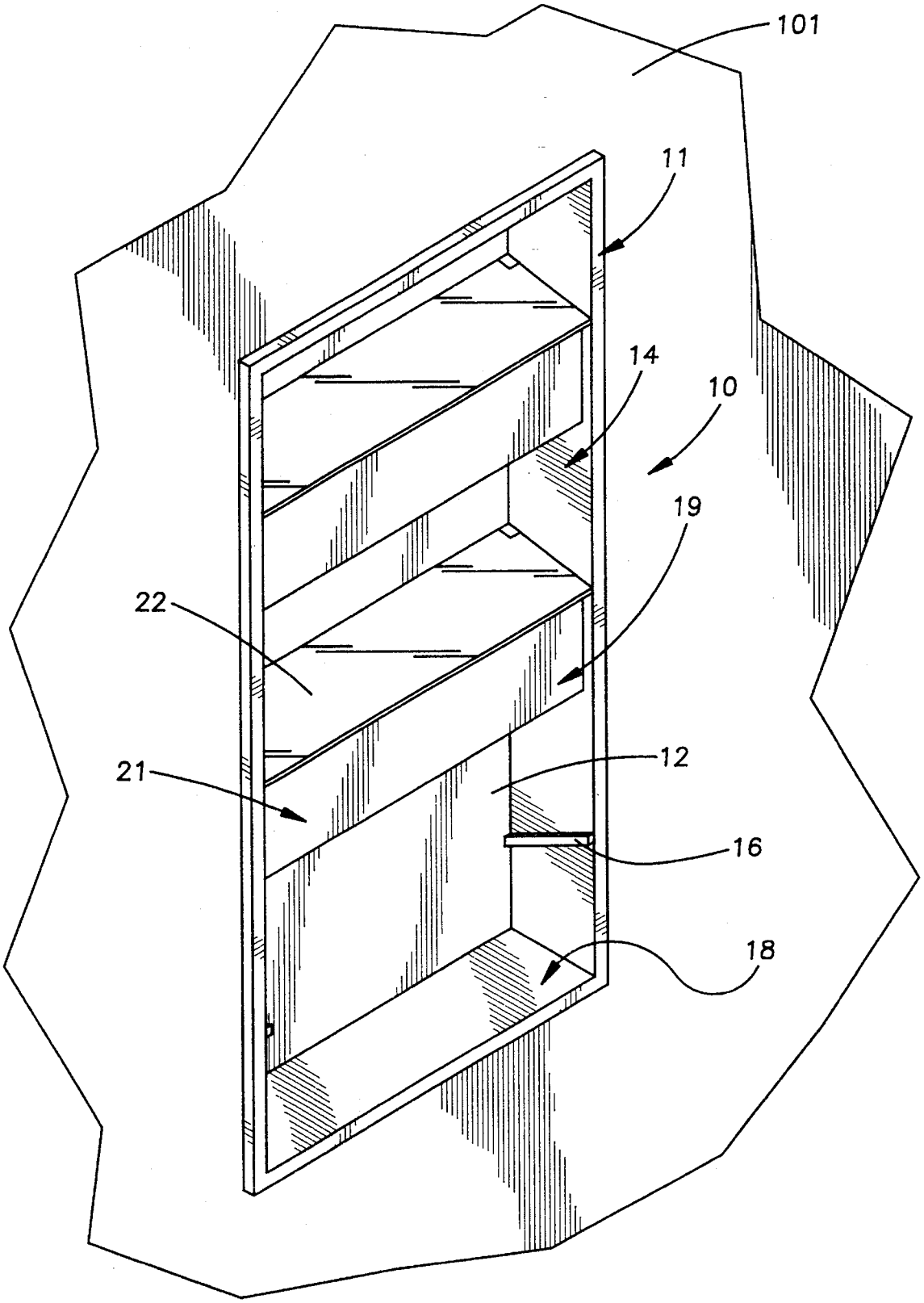
FIG. 2 is a perspective view of the Storage Assembly shown placed in a wall member and showing the wall in a partial view.
Figure 3:
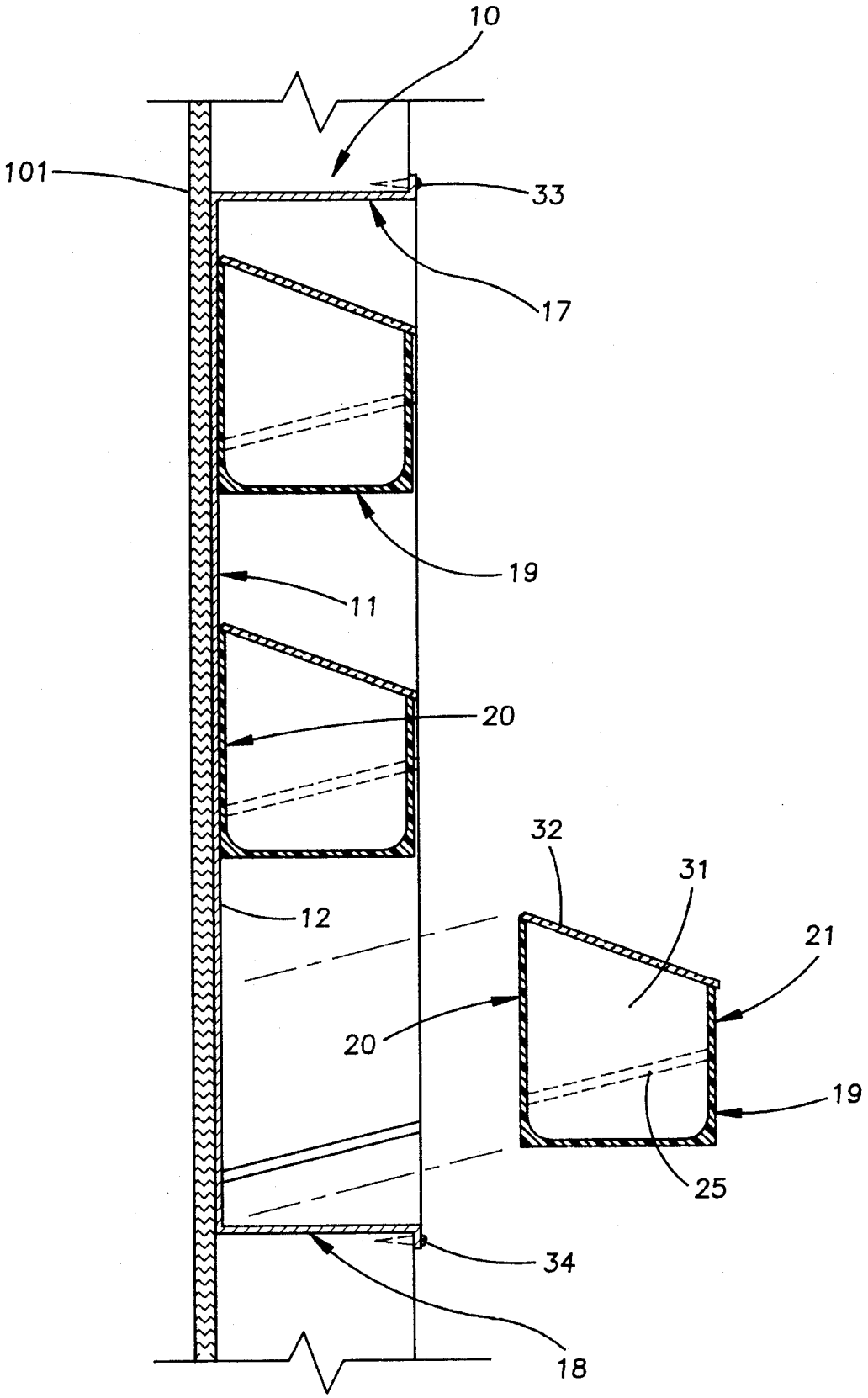
FIG. 3 is a partial cross-sectional view of the Storage Assembly taken along lines 3—3 of FIG. 1. A cross-sectional view of a storage bin is projected out from the storage rack to illustrate the sliding interface of the grooves of the bin with the rails of the rack.
Figure 4:
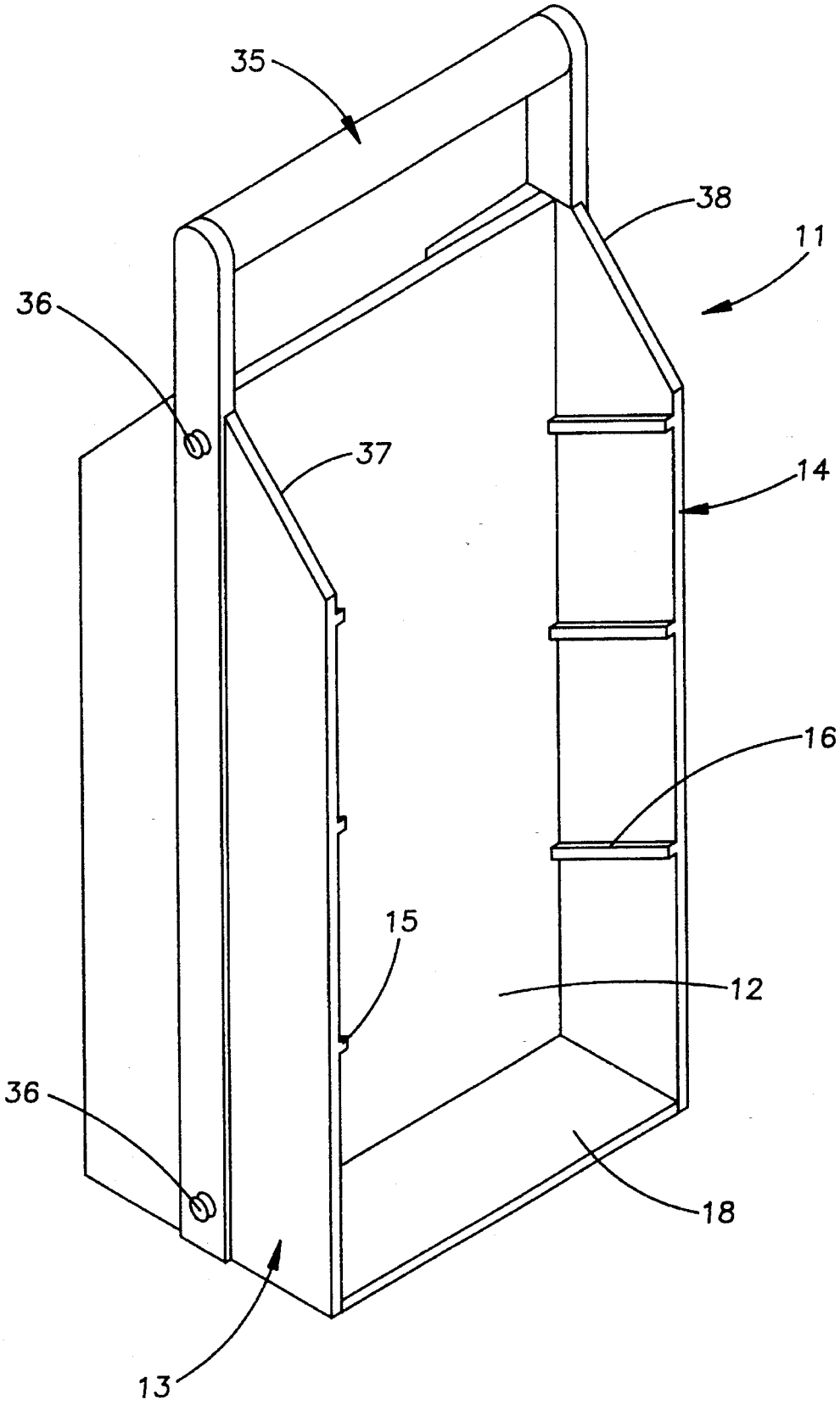
FIG. 4 is a perspective view of the Storage Assembly less the storage bins and showing a handle connected to the left and right side rack walls for ease of transport to a job site and showing that the Storage Assembly could have storage bins placed on two sides of the storage rack by extending the left and right side rack walls.

Referring to FIGS. 1 through 5, a storage assembly 10 is shown and described that has a storage rack 11. The storage rack 11 has a back rack wall 12, a right side rack wall 13 connected to the back rack wall 12 and a left side rack wall 14 connected to the back rack wall 11. The left side rack wall 14 directly opposes the right side rack wall 13. The left side rack wall 14 and the right side rack wall 13 may be extended as shown in FIG. 4 to allow storage bins 19 to be placed on both sides of the back rack wall 12 or one-sided as shown in FIG. 3. The upper edge 37 of the right side rack wall and the upper edge 38 of the left side rack wall may be cut at an angle as shown in FIG. 4 to deflect an object dropped onto the rack away from the bins to reduce the chance of damage to the bins or to reduce spillage from the bins.

At least one first rail 15, but preferably a plurality of first rails 15, is/are connected to the right side rack wall 13. At least one second rail 16, but preferably a plurality of second rails 16, is/are connected to the left side rack wall 14. The second rails 16 directly oppose the first rails 15 (FIG. 3). The rails of the left and right side rack walls slidingly engage the grooves of the left and right side bin walls. There is a bottom rack wall 18 connected to the back rack wall 11 (See FIG. 4). The bottom rack wall 18 is also connected to the left side rack wall 14 and is connected to the right side rack wall 13.

There may also be a top rack wall 17 connected to the back rack wall 11 (See FIGS. 1, 2 and 3). The top rack wall 17 is also connected to the left side rack wall 14 and is connected to the right side rack wall 13.

Figure 5:
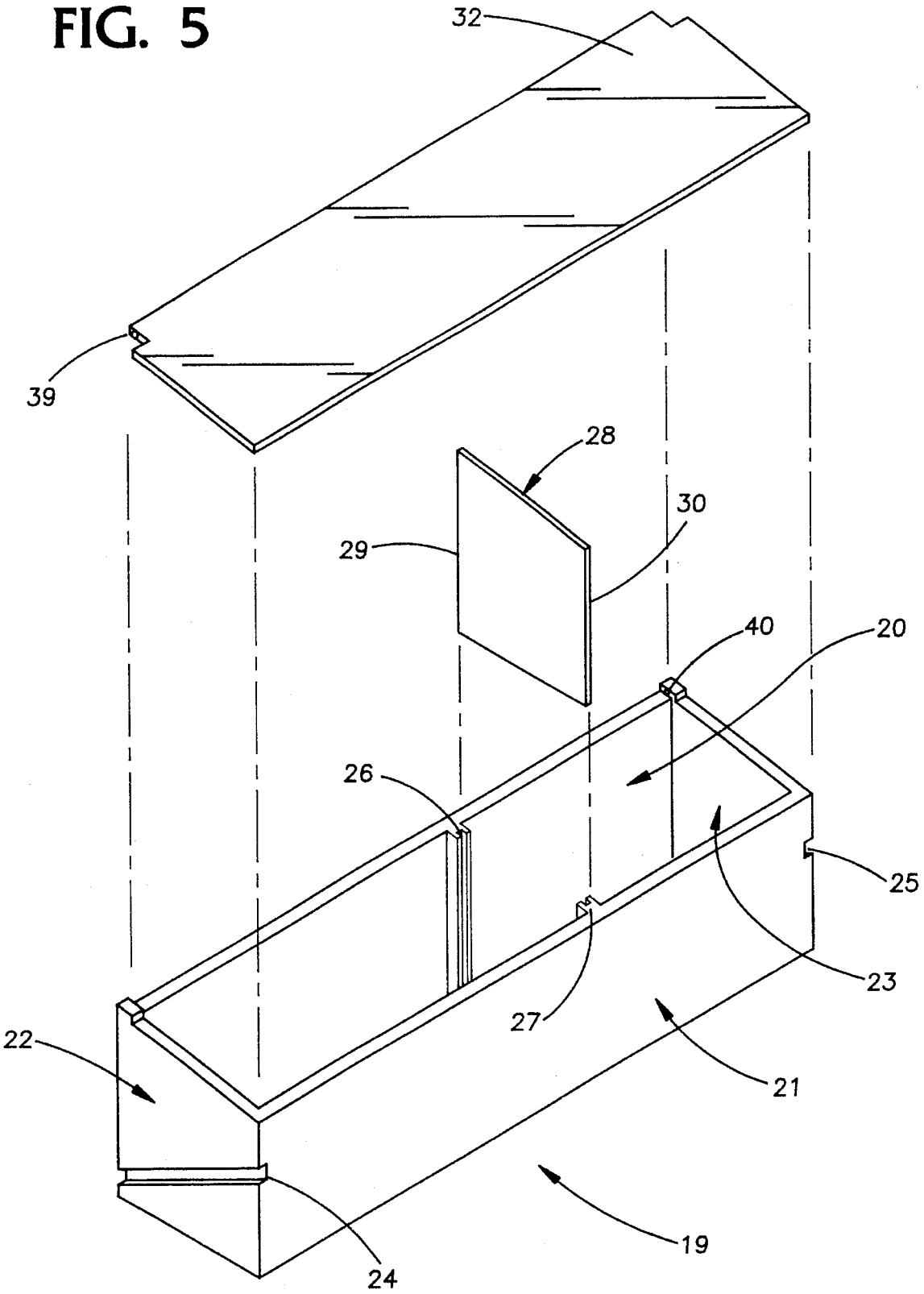
FIG. 5 is an exploded perspective view of the storage bin showing the lid and the partition wall.

There is at least one storage bin 19 that has a back bin wall 20 and a front bin wall 21. Preferably there are several storage bins 19 that may be placed into the rack 11. Each bin 19 may have different parts and pieces (not shown), for a job, placed therein so that the bins may be utilized for different jobs or different stages of the same job. The storage bin 19 has a right side bin wall 22 connected to the back bin wall 20 and connected to the front bin wall 21. There is a left side bin wall 23 connected to the back bin wall 20 and connected to the front bin wall 21. The left side bin wall 23 opposes (i.e. is directly across from) the right side bin wall 22. There is a first groove 24, to slidingly receive the first rail 15, in the right side bin wall 22. There is a second groove 25, to slidingly receive the second rail 16, in the left side bin wall 23 (FIGS. 3 and 5). There is a third groove 26 in the back bin wall 20 and a fourth groove 27, in the front bin wall 21. The fourth groove 27 directly opposes the third groove 26.

A removable partition wall 28 (FIG. 5) has a rear edge 29 slidingly inserted in the third groove 26 and a front edge 30 slidingly inserted in the fourth groove 27. There may be more than one removable partition 28 and corresponding grooves, similar to the third and fourth grooves, in the front and back bin walls. There could be partitions (not shown but similar to the partition 28) connecting the removable partitions 28 and perpendicular to the partition 28 to provide even smaller compartments in the inner chamber 31 of bin 19. A transparent lid 32 is pivotally connected, by pivot lug 39 on the lid 32 which pivots in pivot indent 40 on the right side bin wall 22.

There may be at least one first fastener 33 (usually two or more, such as a screw) connected to the top rack wall 17 and at least one second fastener 34 (usually two or more, such as a screw) connected to the bottom rack wall 18 to threadingly and removably attach the storage rack 11 to a fixed upright member 100 (See FIG. 3, such as a 2×4). There may be a removable handle 35 (FIG. 4) attached to the left side rack wall 14 and attached to the right side rack wall 13 to allow the storage assembly 10 to be easily carried to the job site. The handle 35 may be attached by threaded fasteners 36 or there could be lugs (not shown) on the handle 35 that would mate to compatible ports (not shown) in the right side rack wall 13 and left side rack wall 14 of the rack 11. The walls, rails, partitions and lid may be assembled utilizing standard fasteners such as screws, nails or adhesives. The lid 32 may be made of a transparent plastic.

In operation, parts and tools designated for a particular job can be placed within a preselected bin 19. That bin can be placed in a stationary rack 11 to be utilized from the stationary rack or removed to a transportable rack 11 (FIG. 4), having a handle 35, to facilitate its transportation to a remote job site. The stationary rack 11 (FIGS. 1 and 2) may be placed between and fastened to the standard supports 100 found within most wall structures found in a building (FIG. 1) or if such uprights supports 100 are not available the rack 11 may be supported by any other sturdy wall structure 101 (FIGS. 2 and 3).

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

We claim:

1. A storage assembly comprising:

(a) a storage rack comprising:
- a back rack wall;
- a right side rack wall connected to the back rack wall;
- a left side rack wall connected to the back rack wall and opposing the right side rack wall;
- at least one first rail connected to the right side rack wall;
- at least one second rail connected to the left side rack wall and opposing the first rail; and
- a handle attached to the left side rack wall and attached to the right side rack wall.

(b) at least one storage bin comprising:
- a back bin wall;
- a front bin wall;
- a right side bin wall connected to the back bin wall and to the front bin wall;
- a left side bin wall, connected to the back bin wall and to the front bin wall, opposing the right side bin wall;
- a first groove, to receive the first rail, in the right side bin wall;
- a second groove, to receive the second rail, in the left side bin wall;
- a third groove in the back bin wall;
- a fourth groove, in the front bin wall, opposing the third groove;
- a removable partition wall having a rear edge inserted in the third groove and having a front edge inserted in the fourth groove; and
- a transparent lid pivotally connected to the right side bin wall.

2. A storage assembly comprising:

(a) a storage rack comprising:
- a back rack wall;
- a right side rack wall connected to the back rack wall;
- a left side rack wall connected to the back rack wall and opposing the right side rack wall;
- at least one first rail connected to the right side rack wall;
- at least one second rail connected to the left side rack wall and opposing the first rail;
- a bottom rack wall connected to the back rack wall and connected to the left side rack wall and connected to the right side rack wall;
- a top rack wall;
- at least one first fastener connected to the top rack wall and at least one second fastener connected to the bottom rack wall to removably attach the storage rack to a fixed upright member; and
- a handle attached to the left side rack wall and attached to the right side rack wall; and (b) at least one storage bin comprising:
- a back bin wall;
- a front bin wall;
- a right side bin wall connected to the back bin wall and to the front bin wall;
- a left side bin wall, connected to the back bin wall and to the front bin wall, opposing the right side bin wall;
- a first groove, to receive the first rail, in the right side bin wall;
- a second groove, to receive the second rail, in the left side bin wall;
- a third groove in the back bin wall;
- a fourth groove, in the front bin wall, opposing the third groove;
- a removable partition wall having a rear edge inserted in the third groove and having a front edge inserted in the fourth groove; and
- a transparent lid pivotally connected to the right side bin wall.

3. A storage assembly as described in claim 2 wherein the storage rack further comprises a top rack wall connected to the back rack wall and connected to the left side rack wall and connected to the right side rack wall.

4. A storage assembly comprising:

(a) a storage rack comprising:
- a back rack wall;
- a right side rack wall connected to the back rack wall;
- a left side rack wall connected to the back rack wall and opposing the right side rack wall;
- at least one first rail connected to the right side rack wall;

at least one second rail connected to the left side rack wall and opposing the first rail;

a bottom rack wall connected to the back rack wall and connected to the left side rack wall and connected to the right side rack wall; and a handle attached to the left side rack wall and attached to the right side rack wall; and (b) at least one storage bin comprising:

a back bin wall;

a front bin wall;

a right side bin wall connected to the back bin wall and to the front bin wall;

a left side bin wall, connected to the back bin wall and to the front bin wall, opposing the right side bin wall;

a first groove, to receive the first rail, in the right side bin wall;

a second groove, to receive the second rail, in the left side bin wall;

a third groove in the back bin wall;

a fourth groove, in the front bin wall, opposing the third groove;

a removable partition wall having a rear edge inserted in the third groove and having a front edge inserted in the fourth groove; and a transparent lid pivotally connected to the right side bin wall.

5. A storage assembly as described in claim 4 wherein the storage rack further comprises a top rack wall connected to the back rack wall and connected to the left side rack wall and connected to the right side rack wall.

* * * * *